US007101006B2

(12) United States Patent
Kyoshima

(10) Patent No.: US 7,101,006 B2
(45) Date of Patent: Sep. 5, 2006

(54) PRINTHEAD SUBSTRATE, PRINTHEAD, TEMPERATURE CONTROL METHOD OF PRINTHEAD, AND PRINTING APPARATUS

(75) Inventor: Masayuki Kyoshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 10/816,811

(22) Filed: Apr. 5, 2004

(65) Prior Publication Data

US 2004/0201637 A1 Oct. 14, 2004

(30) Foreign Application Priority Data

Apr. 10, 2003 (JP) ..... 2003-106792

(51) Int. Cl.
*B41J 29/38* (2006.01)
*B41J 2/15* (2006.01)

(52) U.S. Cl. ..... 347/10; 347/17; 347/20

(58) Field of Classification Search ..... 347/11, 347/12, 10

See application file for complete search history.

(56) References Cited

U.S. PATENT DOCUMENTS

| | | | | |
|---|---|---|---|---|
| 5,175,565 | A | 12/1992 | Ishinaga et al. | |
| 5,191,357 | A * | 3/1993 | Ono | 347/186 |
| 5,867,200 | A * | 2/1999 | Tajima et al. | 347/211 |
| 6,022,096 | A * | 2/2000 | Hirasawa et al. | 347/43 |
| 6,027,198 | A * | 2/2000 | Tanaka et al. | 347/12 |
| 6,471,320 | B1 * | 10/2002 | Anderson | 347/12 |
| 6,616,257 | B1 * | 9/2003 | Imanaka et al. | 347/10 |
| 2003/0189608 | A1 * | 10/2003 | Hung et al. | 347/9 |

* cited by examiner

*Primary Examiner*—K. Feggins
*Assistant Examiner*—Shelby Fidler
(74) *Attorney, Agent, or Firm*—Fitzpatrick, Cella, Harper & Scinto

(57) ABSTRACT

This invention provides simpler, low-cost printhead temperature adjustment means without complicating the driver arrangement of a printhead substrate. In a printing apparatus to which this invention is applied, when printing by alternately driving two printheads having the same arrangement, if one of these printheads is in printing, a driving signal having a short pulse width insufficient to print is input to the other printhead to drive all printing elements.

1 Claim, 12 Drawing Sheets

FIG. 10

TRUTH TABLE OF LATCH CIRCUIT

| INPUT | | OUTPUT |
|---|---|---|
| DATA | RESET | |
| L | L | L |
| H | L | H |
| L | H | H |
| H | H | H |

PRINTHEAD SUBSTRATE, PRINTHEAD, TEMPERATURE CONTROL METHOD OF PRINTHEAD, AND PRINTING APPARATUS

CLAIM OF PRIORITY

This application claims priority from Japanese Patent Application No. 2003-106792, entitled "Printhead Substrate, Printhead, Temperature Control Method of Printhead, and Printing Apparatus" and filed on Apr. 10, 2003, the entire contents of which are incorporated herein by reference.

FIELD OF THE INVENTION

This invention relates to a printhead substrate, a printhead, a temperature control method of the printhead, and a printing apparatus and, more particularly, to a printhead substrate, a printhead, a temperature control method of the printhead, and a printing apparatus which are used to print in accordance with an inkjet printing method.

BACKGROUND OF THE INVENTION

A printhead mounted in an inkjet printing apparatus typically includes a nozzle plate which is connected and attached to a printhead substrate (to be referred to as a head substrate hereinafter) at an interval. The nozzle plate includes ink discharge nozzles which are arranged in association with a plurality of printing elements (heaters) attached onto the head substrate. In energizing and driving a specific printing element, ink adjacent to it abruptly expands and bubbles. The bubbling force discharges ink onto a printing medium via the orifice of the ink discharge nozzle.

When a plurality of printing elements (heaters) attached to the printhead are driven, the printhead temperature and ink temperature rise. A change in ink temperature leads to a change in physical characteristic such as ink viscosity or surface tension. The discharge speed of ink droplets discharged onto a printing medium changes along with a change in ink temperature within the printhead. This change influences the printing quality.

Conventionally, in order to maintain ink in the printhead at an almost desired operating temperature, at least one heater (sub-heater) is attached to the head substrate, and the head substrate is heated using this sub-heater or a pulse short enough not to discharge ink is applied to a printing element (heater). This adjusts the printhead temperature, achieving a more uniform, higher printing quality. The sub-heater and printing element (heater) used for temperature adjustment are typically driven in powering on the printhead or while the printhead is idle, so as to maintain ink in the printhead at an almost desired operating temperature.

A conventional printhead using at least one sub-heater typically includes a driver circuit which drives the sub-heater and is separated from a driver circuit for driving a printing element (heater). By using these separated driver circuits, the sub-heater can be selectively driven independently of the printing element (heater), as disclosed in, e.g., U.S. Pat. No. 5,175,565.

However, the arrangement using the sub-heater, the driver dedicated to the sub-heater, and their interconnection circuit, like the above prior art, raises the production cost of the printhead. As a result, the production cost of the printing apparatus which incorporates and controls the printhead becomes high, and the control becomes complicated.

In some cases, printing is also conventionally controlled by using head substrates having no sub-heater as head substrates dedicated to color printing and monochrome printing, and alternately performing color printing and monochrome printing. The temperature is adjusted by natural cooling of a temperature rise caused by driving a printing element.

FIG. 11 is a circuit diagram showing the conventional arrangement of two head substrates dedicated to color printing and monochrome printing.

FIG. 12 is a timing chart showing various signals input to the head substrates shown in FIG. 11.

In the circuit arrangement shown in FIG. 11, printing is exclusively so controlled as to alternately execute color printing and monochrome printing. Thus, a printing signal line (DATA), clock signal line (CLK), and latch signal line (LATCH) are common to a monochrome printing head substrate 100K and a color printing head substrate 100C.

The head substrates 100K and 100C basically have the same arrangement. That is, N printing elements (heaters) 101 are connected to MOS-FET transistors 102 for driving them. The gates of the MOS-FET transistors 102 are connected to the outputs of AND circuits 103. One input of each AND circuit 103 is connected to a heat pulse signal line (ENBK or ENBC), and the other input is connected to the output of a latch circuit 104.

A shift register 106 receives and temporarily stores a printing signal via the printing signal line (DATA) in synchronism with a clock signal supplied by the clock signal line (CLK). When a latch signal is input via the latch signal line (LATCH), printing data is latched by the latch circuit 104 by the next processing.

Another shift register 107 receives a group signal via a group signal line (GRPK or GRPC) in synchronism with a clock signal supplied via the clock signal line (CLK). The group signal is decoded by a decoder 108 into a block selection signal for time-divisionally controlling a plurality of printing elements. The block selection signal is input to one input terminal of each AND circuit, and the other input terminal receives a printing signal from the shift register 106. The latch circuit 104 latches the logical operation result of each AND circuit 105.

As is apparent from FIG. 11, the monochrome printing head substrate 100K and color printing head substrate 100C are connected to dedicated lines as group signal lines and heat pulse signal lines (ENBK and ENBC). This is because the division number and driving order of time division driving are different between color printing and monochrome printing and individual control is necessary.

Each of the head substrates 100K and 100C supports N printing elements. On the color printing head substrate 100C, N/3 printing elements of the N printing elements are used for printing using each of cyan (C) ink, magenta (M) ink, and yellow (Y) ink. In color printing, a color printing signal (CDATA) for a cyan component, a color printing signal (MDATA) for a magenta component, and a color printing signal (YDATA) for a yellow component are sequentially input via the printing signal line (DATA).

In this manner, heat pulse signal lines are separately arranged for the respective head substrates. For example, when monochrome printing is performed using the head substrate 100K, as shown in FIG. 11, a heat pulse supplied via the heat pulse signal line (ENBK) changes to high level, and a heat pulse supplied via the heat pulse signal line (ENBC) connected to the head substrate 100C changes to low level. The printing elements of the head substrate 100C become idle.

For example, when the printhead integrating both the head substrates 100K and 100C is mounted on the carriage of the printing apparatus and the printing apparatus prints while scanning the carriage, color printing and monochrome printing are so controlled as not to overlap each other in the same scanning. In other words, the head substrates 100K and 100C are alternately driven in each scanning to make one of the two head substrates idle. Thus, heat generated by printing operation can be dissipated due to natural cooling.

In FIG. 11, $V_H$ represents a driving voltage supply line, and GND represents a ground line.

In this arrangement, the use of common signal lines can simplify the circuit arrangement, but the temperature cannot be intentionally adjusted. The problem of temperature control cannot be fully solved.

In the arrangement in which printing is exclusively performed for each substrate using common signal lines, a heater which is controlled independently of an arrangement used for printing must be arranged on the head substrate in order to adjust the temperature by heating on a head substrate which does not print. This increases the head substrate area, and the cost rises due to a large area.

SUMMARY OF THE INVENTION

Accordingly, the present invention is conceived as a response to the above-described disadvantages of the conventional art.

For example, a substrate for printhead according to the present invention is capable of performing proper temperature adjustment at low cost without complicating the circuit arrangement.

According to this aspect of the present invention, preferably, there is provided a printhead substrate has a plurality of printing elements, each including an electrothermal transducer, comprising: a selection circuit which selects, in accordance with an input control signal, a printing signal input and a predetermined signal for driving the printing elements; and an input unit which inputs a driving signal for driving the plurality of printing elements, wherein in a case where printing operation by driving the plurality of printing elements in accordance with the printing signal is suppressed, the selection circuit selects the predetermined signal, and drives the printing elements on the basis of the predetermined signal by a short pulse signal insufficient to print.

According to another aspect of the present invention, preferably, there is provided a printhead using a printhead substrate having the above arrangement as a first printhead substrate.

More preferably, the printhead comprises a second printhead substrate, and at least one shared signal line between the first printhead substrate and the second printhead substrate.

The printhead has the above arrangement as a basic form, and may also comprise at least any one of the following three arrangements as a specific arrangement.

(1) The printhead is configured such that a selection signal for time-divisionally driving the plurality of printing elements and the control signal are input via dedicated signal lines in the first printhead substrate, and the control signal functions as a signal for selecting the printing signal in a case where printing operation is performed by driving the plurality of printing elements in accordance with the printing signal, while the control signal functions as a signal for selecting the predetermined signal in a case where printing operation is not performed by driving the plurality of printing elements in accordance with the printing signal.

(2) The printhead is configured such that a selection signal for time-divisionally driving the plurality of printing elements and the control signal are input via one shared signal line, the control signal includes at least a 2-bit signal, and one bit of at least the 2-bit signal is input as a dedicated control signal to the selection circuit exclusively from the second printhead substrate.

(3) The printhead is configured such that the first printhead substrate further comprises a shift register which receives via one shared signal line the printing signal, a selection signal for time-divisionally driving the plurality of printing elements, and the control signal, and a latch circuit which latches the printing signal and the control signal input to the shift register, the latch circuit includes the selection circuit, the control signal includes at least a 2-bit signal, and one bit of at least the 2-bit signal is input as a dedicated control signal to the selection circuit exclusively from the second printhead substrate.

In any arrangement, the printhead prints by alternately inputting the printing signal via the shared signal line to the first printhead substrate and the second printhead substrate.

By virtue of the above arrangement, the printhead capable of heating the head can be implemented although sharing signal lines between first and second printhead substrates without arranging any independent heater.

Note that the printhead may be an inkjet printhead which prints by discharging ink, and may further integrally comprise an ink tank which supplies the ink.

According to still another aspect of the present invention, there is provided a printing apparatus for printing by discharging ink onto a printing medium using a printhead having the above first and second printhead substrates.

In this case, the printing apparatus may preferably comprises: a first ink tank which stores black ink to be used for print operation in the first printhead substrate; and a second ink tank which stores cyan ink, magenta ink, and yellow ink to be used for print operation in the second printhead substrate. Further, this printhead may be exchangeable.

According to still another aspect of the present invention, there is provided a printhead temperature control method.

The method has the following steps.

That is, a printhead temperature control method in a case where printing is performed by exclusively driving a first and second printhead substrates, of a printhead, with the same arrangement each of which has a plurality of printing elements, each including an electrothermal transducer, preferably comprises the steps of: inputting a printing signal to the first printhead substrate via a signal line being shared with the second printhead substrate; inputting a control signal for selecting the printing signal to the first printhead substrate incorporating a selection circuit which selects the printing signal and a predetermined signal for driving all the printing elements; inputting a driving signal for driving the plurality of printing elements of the first printhead substrate, thereby printing; and inputting a control signal for selecting the predetermined signal to the second printhead substrate incorporating the selection circuit so as to drive the printing elements of the second printhead substrate in accordance with a driving signal having a short pulse width insufficient to print.

The printhead desirably includes an inkjet printhead which prints by discharging ink, and the inkjet printhead desirably comprises an electrothermal transducer for generating thermal energy to be applied to ink in order to discharge ink using thermal energy.

With the above arrangement, according to the present invention, when printing by alternately driving two printhead substrates in a printhead, if one of these printhead substrates is used for printing, a driving signal having a short pulse width not enough to print is input to the other of these printhead substrates to drive all printing elements.

The invention is particularly advantageous since the electrothermal transducer included in the printing element of the printhead generates heat to adjust the printhead temperature.

The invention does not require any special temperature adjustment heater without complicating the circuit arrangement, and thus can realize temperature control at lower cost.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 10 is a truth table for a latch circuit shown in FIG. 8;

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

<Brief Description of Apparatus Main Unit (FIG. 1)>

Figure 1:
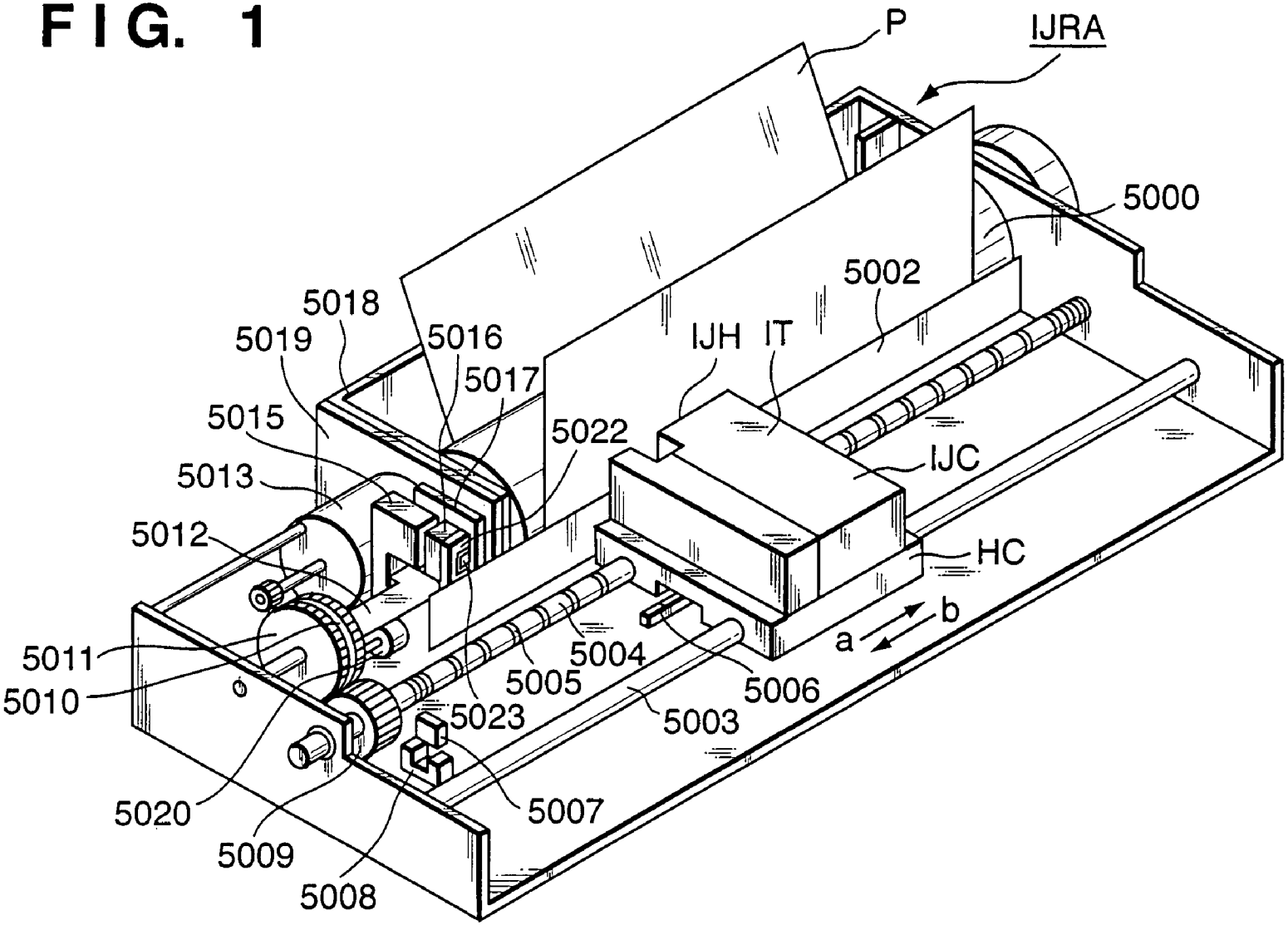
FIG. 1 is an outer perspective view showing a schematic arrangement around the carriage of an inkjet printing apparatus as a typical embodiment of the present invention.

FIG. 1 is a perspective view showing the outer appearance of an inkjet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An inkjet cartridge IJC is mounted on the carriage HC. The inkjet cartridge IJC incorporates an inkjet printhead IJH (hereinafter referred to as "printhead") and an ink tank IT for containing ink.

The inkjet cartridge IJC integrally includes the printhead IJH and the ink tank IT.

Reference numeral 5002 denotes a sheet pressing plate, which presses a paper sheet P against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5012 denotes a lever for initiating a suction operation in the suction recovery operation. The lever 5012 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 2:
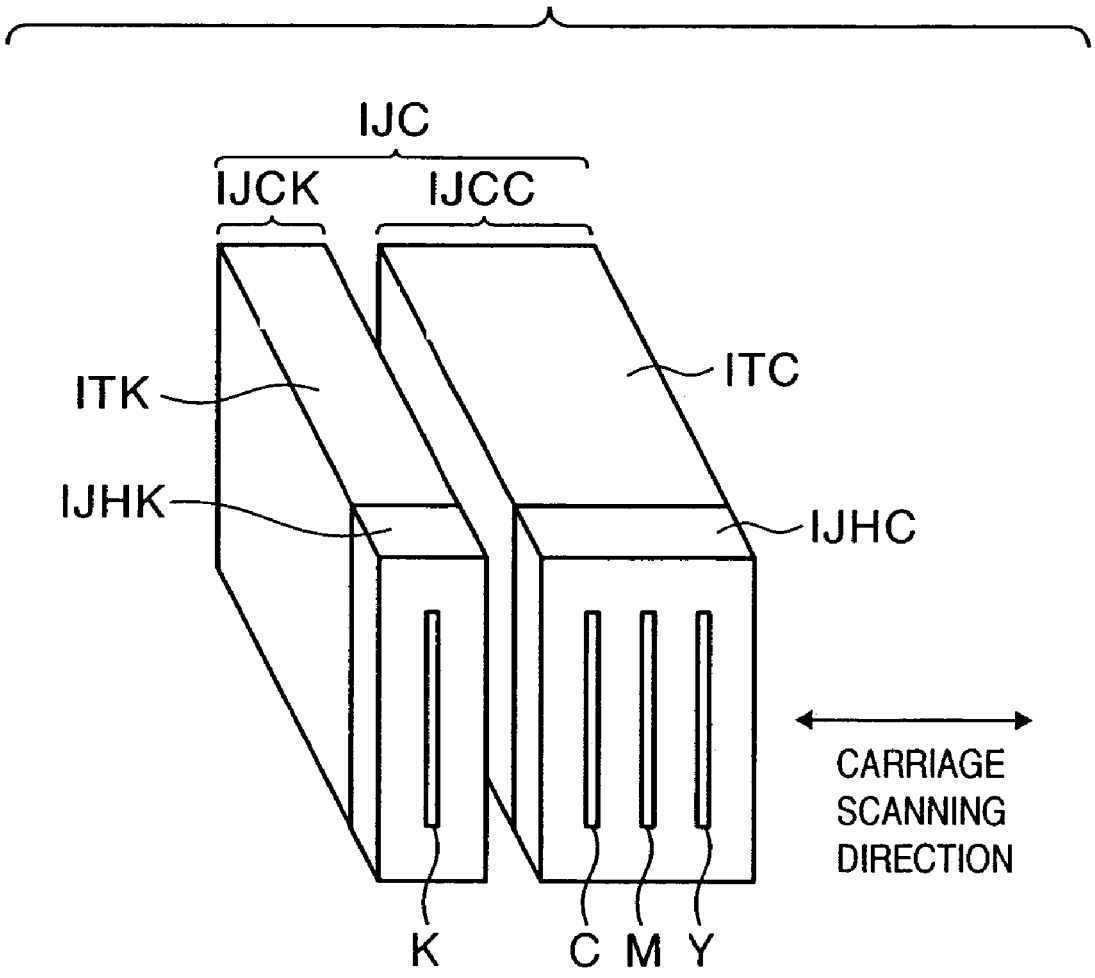
FIG. 2 is an outer perspective view showing the detailed arrangement of an inkjet cartridge IJC.

FIG. 2 is an outer perspective view showing the detailed arrangement of the inkjet cartridge IJC.

As shown in FIG. 2, the inkjet cartridge IJC is comprised of a cartridge IJCK which discharges black ink, and a cartridge IJCC which discharges three color inks of cyan (C), magenta (M), and yellow (Y). These two cartridges is separable from each other, and are independently detachable from the carriage HC.

The cartridge IJCK comprises an ink tank ITK which stores black ink and a printhead IJHK which prints by discharging black ink. The ink tank ITK and printhead IJHK are integrated. Similarly, the cartridge IJCC comprises an ink tank ITC which stores the three color inks of cyan (C), magenta (M), and yellow (Y), and a printhead IJHC which prints by discharging these color inks. The cartridge IJCC and ink tank ITC are integrated.

The printhead IJH is used to generally refer to the printheads IJHK and IJHC together.

As is apparent from FIG. 2, a nozzle array for discharging black ink, a nozzle array for discharging cyan ink, a nozzle array for discharging magenta ink, and a nozzle array for discharging yellow ink are arranged side by side in the carriage moving direction. The nozzle arrayed direction is diagonal to the carriage moving direction.

A control arrangement for executing printing control of the printing apparatus will be explained.

Figure 3:
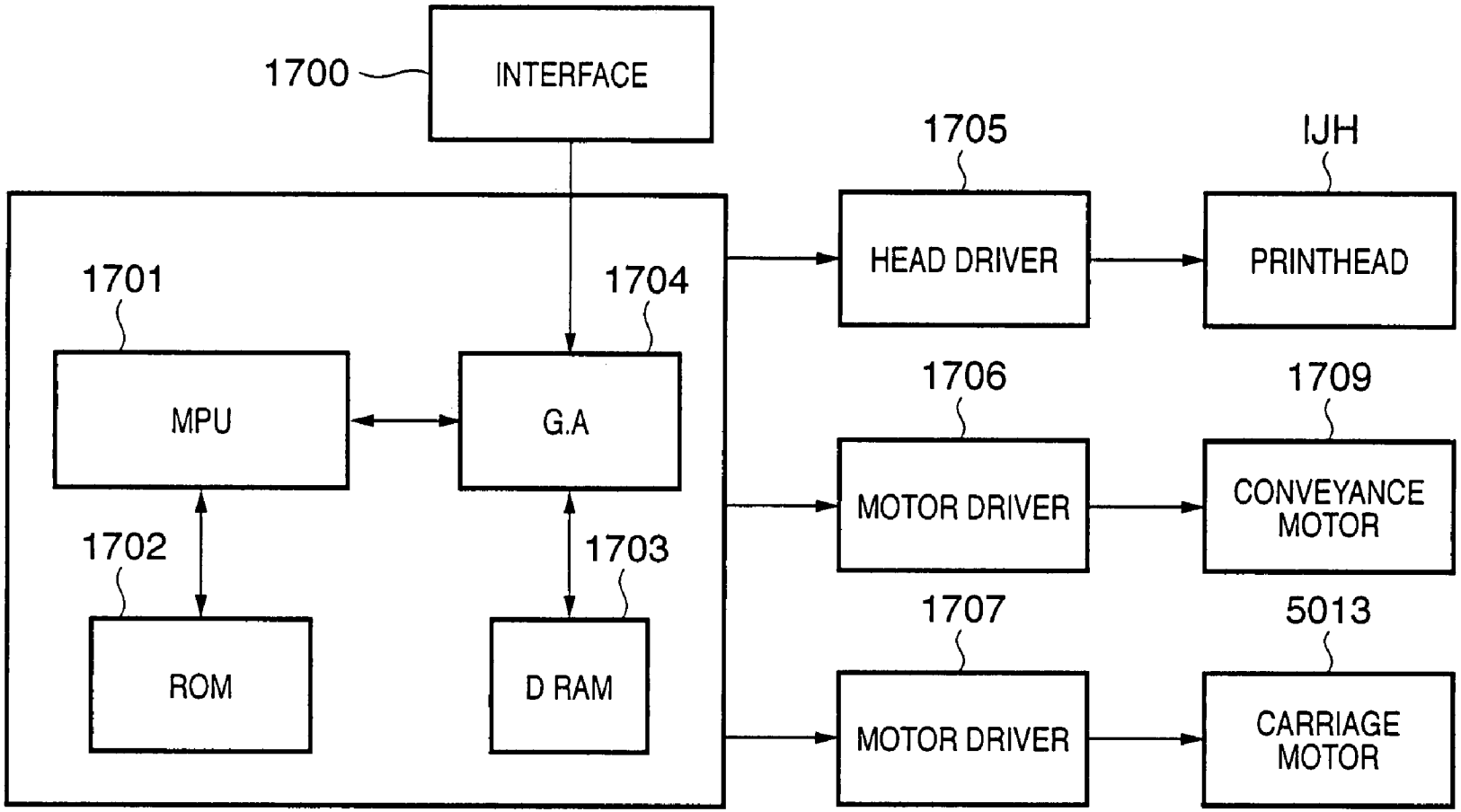
FIG. 3 is a block diagram showing the control arrangement of the printing apparatus shown in FIG. 1.

FIG. 3 is a block diagram showing the arrangement of a control circuit of the printer.

Referring to FIG. 3 showing the control circuit, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703.

Reference numeral 1709 denotes a conveyance motor (not shown in FIG. 1) for conveying a printing sheet P. Reference numeral 1706 denotes a motor driver for driving the conveyance motor 1709, and reference numeral 1707 denotes a motor driver for driving the carriage motor 5013.

The operation of the above control arrangement will be described next. When a printing signal is input to the interface 1700, the printing signal is converted into printing data for printing operation between the gate array 1704 and the MPU 1701. The motor drivers 1706 and 1707 are driven, and the printhead IJH is driven in accordance with the printing data supplied to the carriage HC, thus printing an image on the paper sheet P.

This embodiment uses a printhead having an arrangement as shown in FIG. 2, and controls to prevent overlapping of printing by the printhead IJHK and printing by the printhead IJHC in each scanning of the carriage. In color printing, the printheads IJHK and IJHC are alternately driven for each scanning. For example, when the carriage reciprocally scans, the printhead IJHK is driven in a forward scanning, and the printhead IJHC is driven in a backward scanning. Printhead driving control is not limited to this control, and may be another control such that printing operation is done in only a forward scanning and the printheads IJHK and IJHC are respectively driven in two forward scanning operations without conveying any paper sheet P.

The arrangement and operation of a head substrate integrated in the printhead IJH will be explained.

Figure 4:
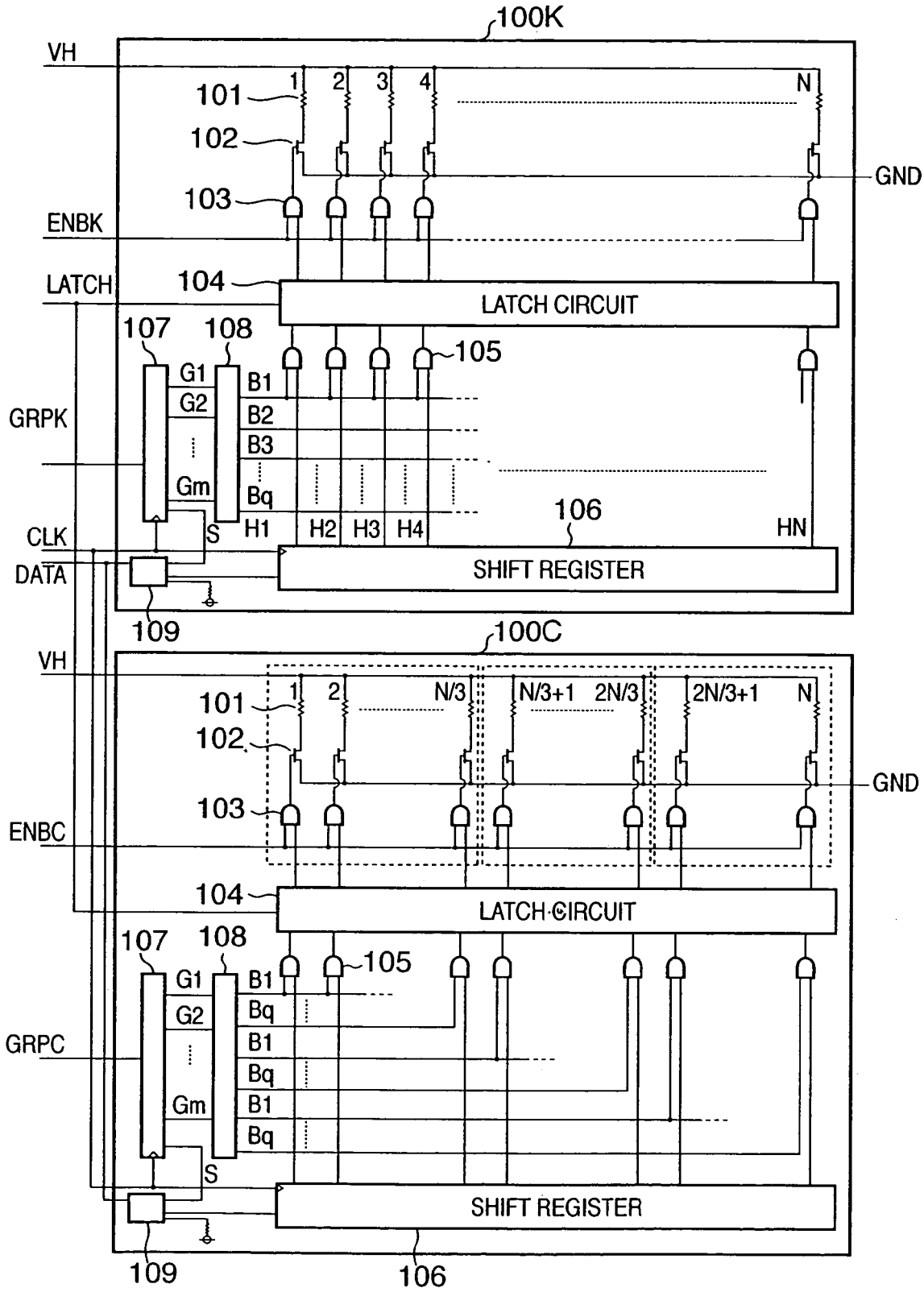
FIG. 4 is a circuit diagram showing the arrangement of head substrates integrated in a printhead IJH.
Figure 11:
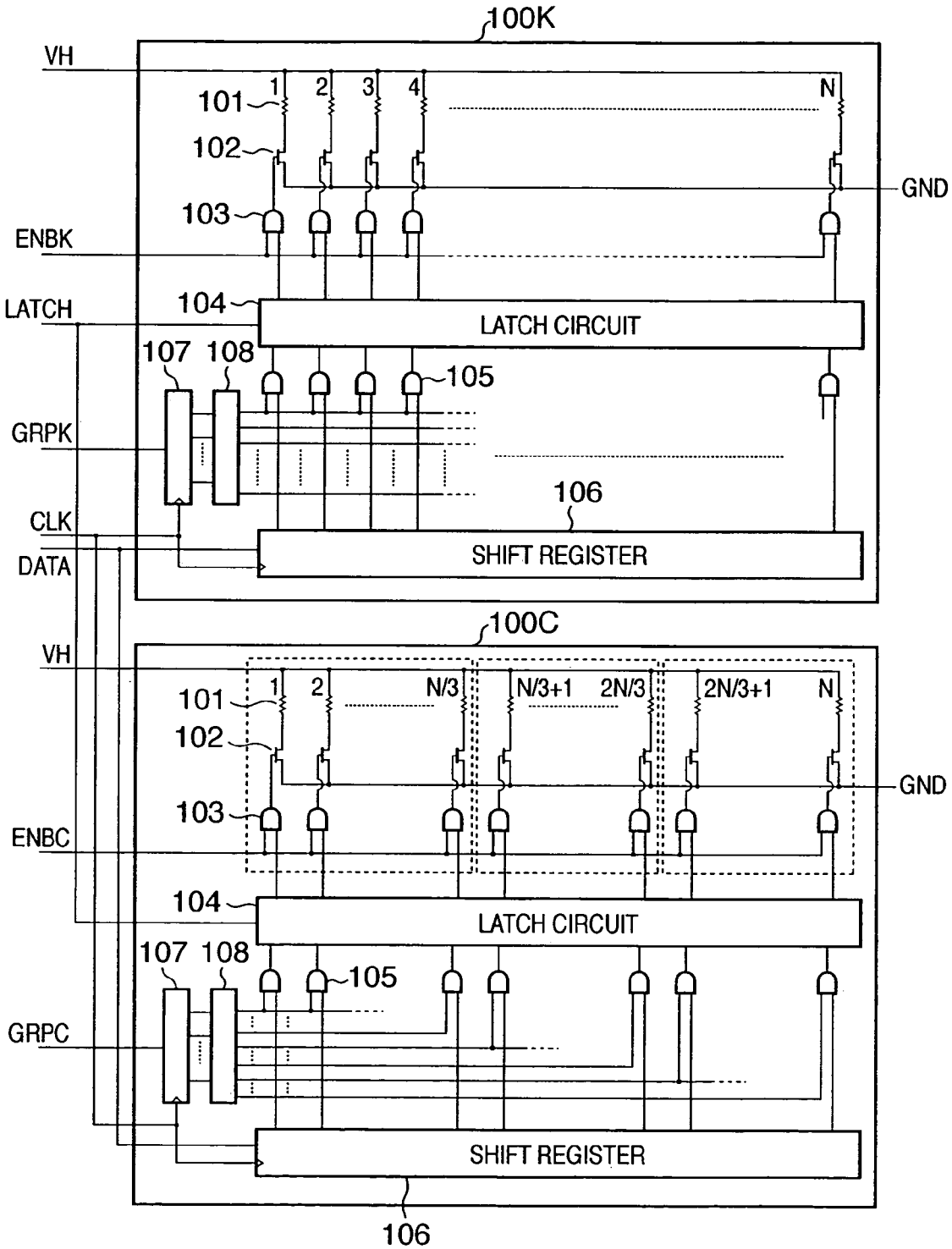
FIG. 11 is a circuit diagram showing the conventional arrangement of two head substrates dedicated to color printing and monochrome printing.
Figure 12:
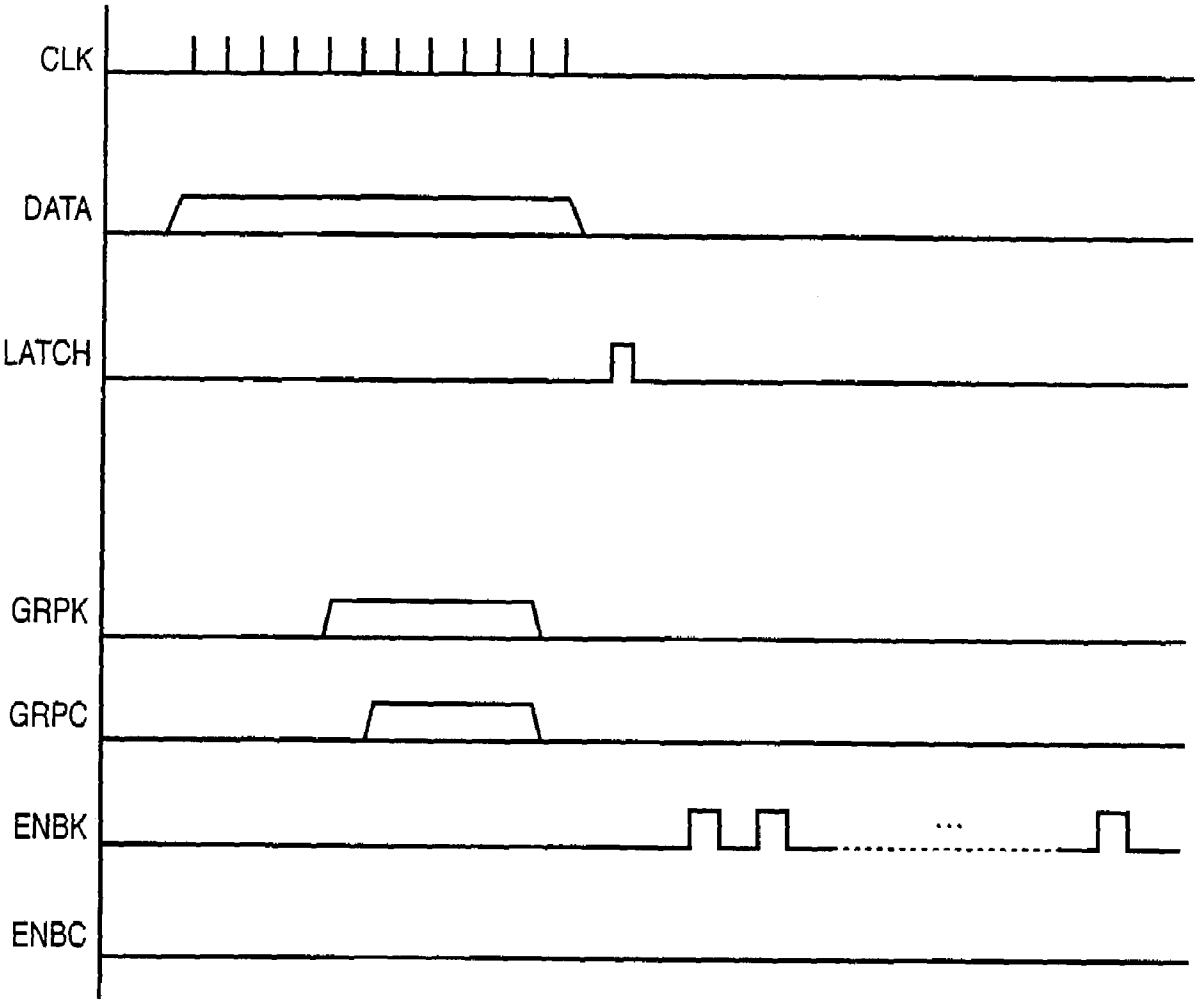
FIG. 12 is a timing chart showing various signals input to the head substrates shown in FIG. 11.

FIG. 4 is a circuit diagram showing the arrangement of the head substrates integrated in the printhead IJH. In FIG. 4, the same reference numerals and signs as in FIG. 11 showing the prior art denote the same constituent elements and signal lines, and a description thereof will be omitted.

As shown in FIG. 2, the printhead IJH is formed by the monochrome printing printhead IJHK and color printing printhead IJHC. A monochrome printing head substrate 100K shown in FIG. 4 is integrated in the printhead IJHK, whereas a color printing head substrate 100C is integrated in the printhead IJHC.

Each of driving circuits formed on the head substrates 100K and 100C includes a shift register 106 for converting printing signals supplied as serial signals into parallel signals corresponding to respective printing elements 101, and a latch circuit 104 for outputting the parallel signals at predetermined timings.

The N printing elements 101 are divided into q groups (i.e., N=p elements×q groups). Group signals for time-divisionally driving each group within one printing cycle are serially input via a group signal line (GRPK or GRPC), and converted by a shift register 107 from the serial signals into parallel signals. Parallel signals G1, G2, . . . , Gm via m signal lines are input to a decoder 108, and converted into q block selection signals corresponding to the respective groups ($2^m$=q).

One signal line extending from the shift register 107 is connected to a switch 109. The switch 109 switches an output to the shift register 106 between a printing signal supplied via a printing signal line (DATA) and a predetermined signal (e.g., a designation signal for designating driving of all printing elements or a signal for designating driving of a selected printing element) in accordance with a data select signal (S) input from the shift register 107. Note that the above predetermined signal includes not only a signal which is unchangeable once preset (i.e. a fixed signal) but also a signal which is changeable depending on printing environment or printing operation even though it is preset.

The data select signal (S) is input after the group signal via the group signal line (GRPK or GRPC).

As shown in FIG. 4, the head substrate 100C also has a driving circuit with almost the same arrangement as that of the head substrate 100K. A printing signal line (DATA), clock signal line (CLK), and latch signal line (LATCH) are shared between the head substrates 100C and 100K. Group signal lines and heat pulse signal lines are independently arranged for the two head substrates.

Figure 5:
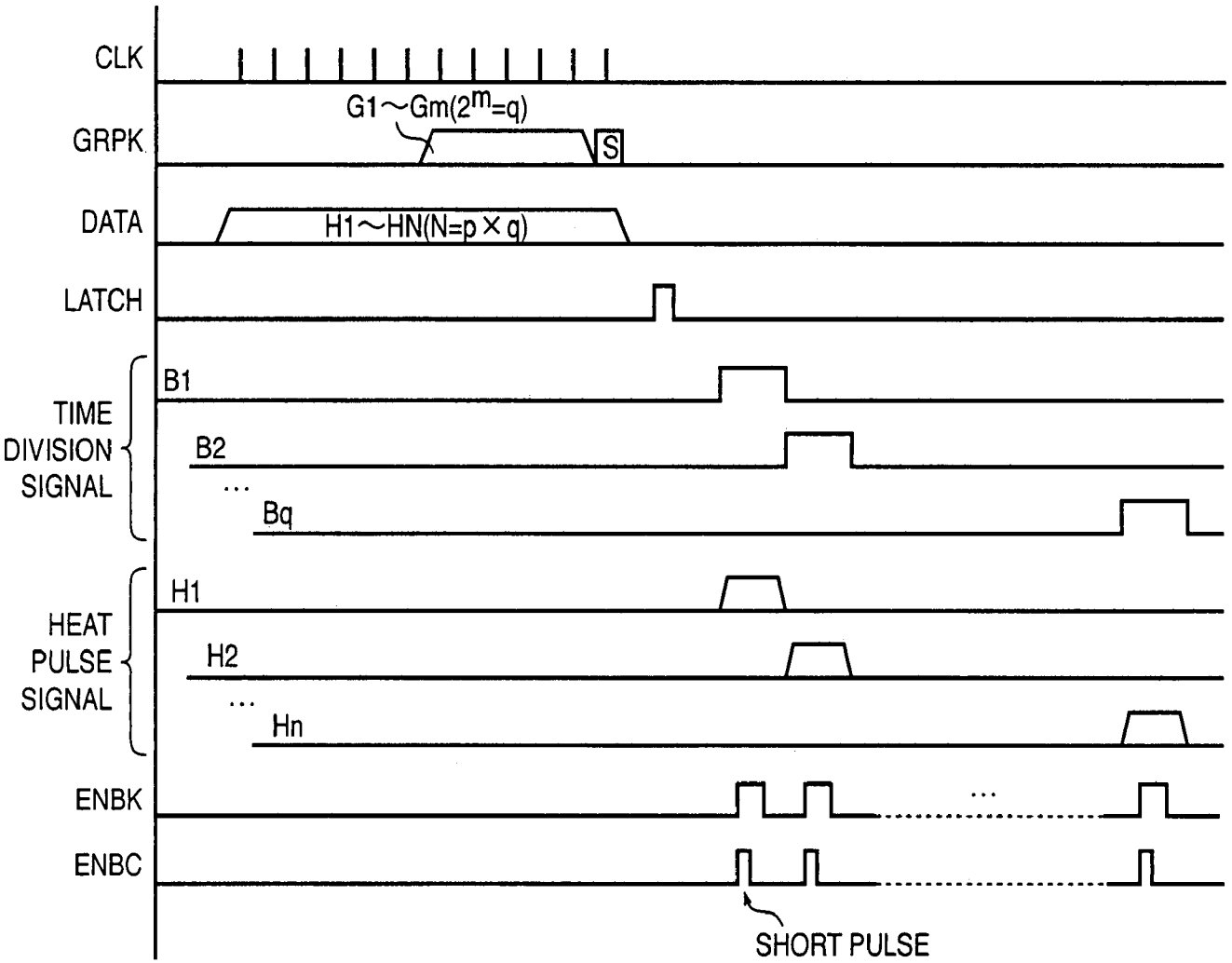
FIG. 5 is a timing chart showing the signals of signal lines which are supplied to the head substrates shown in FIG. 4.

FIG. 5 is a timing chart showing the signals of signal lines which are supplied to the head substrate shown in FIG. 4.

As is apparent from FIG. 5, signals input via the group signal line (GRPK) include the data select signal (S) in addition to the group signals (G1 to Gm). The printing signal and group signals are sequentially transferred to the shift registers 106 and 107 in synchronism with the clock signal. The printing signal is converted into heat signals (H1 to HN) by the shift register 106, and the heat signals (H1 to HN) are latched by the latch circuit 104 in response to the latch signal. The group signals are converted by the decoder 108 into block selection signals (B1 to Bq) for time division driving.

According to the embodiment, when the printhead IJHK prints with black ink, the data select signal (S) of the head substrate 100K causes the switch 109 to select a printing signal input via the printing signal line (DATA).

At this time, the printhead IJHC does not print. As the data select signal (S) of the head substrate 100C, a signal opposite to the data select signal (S) of the head substrate 100K causes the switch 109 to select the predetermined fixed data as described above. The selected data is output to the shift register 106. At this time, a driving pulse having a short pulse width not enough to discharge ink is properly input to the head substrate 100C of the printhead IJHC via the heat pulse signal line (ENBC).

In the next scanning, the printhead to be driven changes to the printhead IJHC, while the printhead IJHK does not print. At this time, a driving pulse having a short pulse width not enough to discharge ink is properly input to the head substrate 100K of the printhead IJHK via the heat pulse signal line (ENBK).

The above-described embodiment can provide adequate heat to the printhead by driving the printing element but not causing to discharge ink even during a non-printing period in an arrangement sharing signal lines, thereby controlling the printhead temperature. The operating temperature of the printhead can be maintained at an almost desired level, the physical characteristic of ink can be relatively maintained at a constant level, and as a result, high-quality printing can be achieved.

Sharing of data signal lines is not limited to the above embodiment. For example, a group signal line (GRP) may also be shared in addition to the arrangement of this embodiment.

Figure 6:
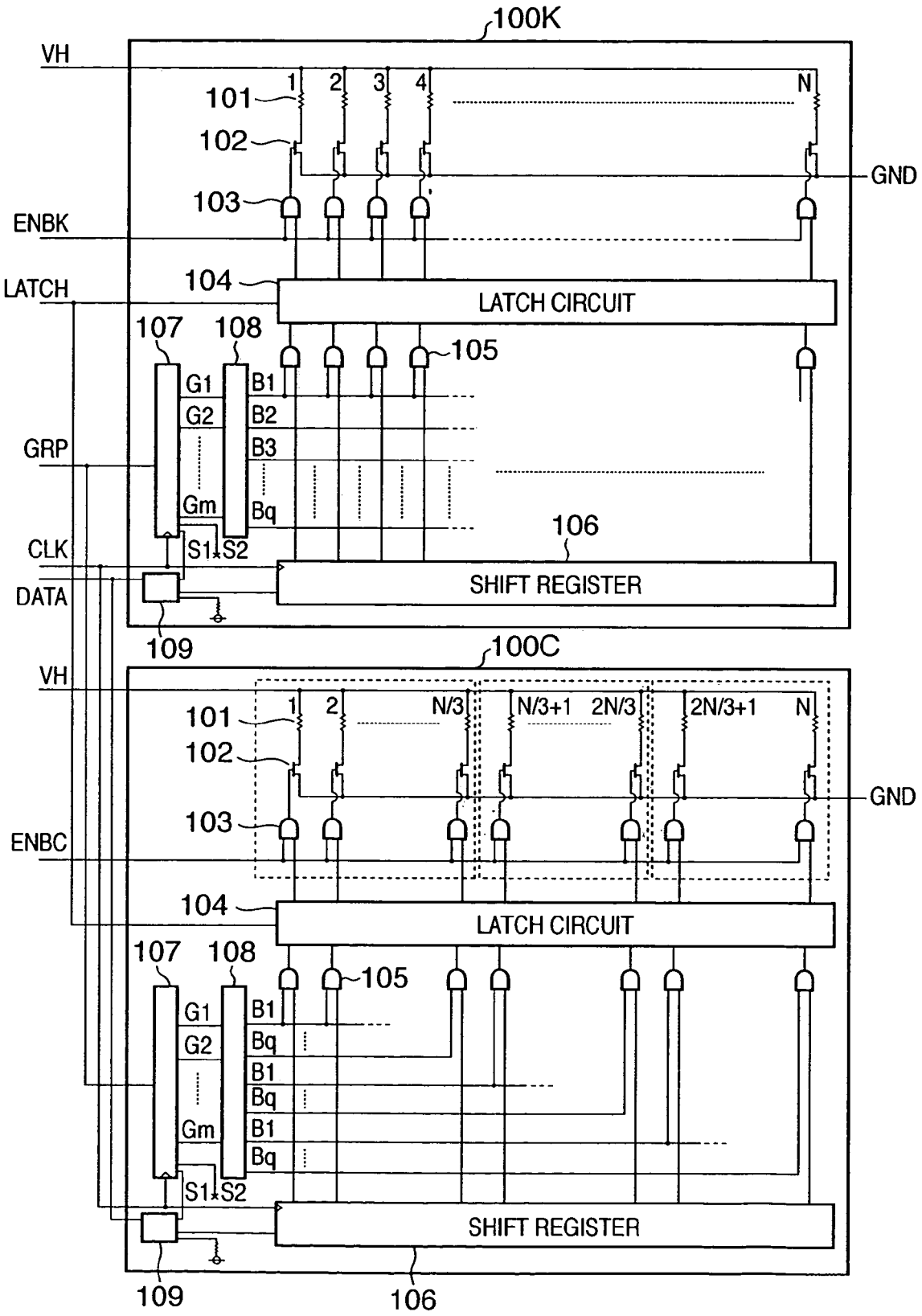
FIG. 6 is a circuit diagram showing the arrangement of head substrates sharing a group signal line (GRP)

FIG. 6 is a circuit diagram showing the arrangement of head substrates sharing the group signal line (GRP). In FIG. 6, the same reference numerals and signs as in FIG. 4 and FIG. 11 showing the prior art denote the same constituent elements and signal lines, and a description thereof will be omitted.

Figure 7:
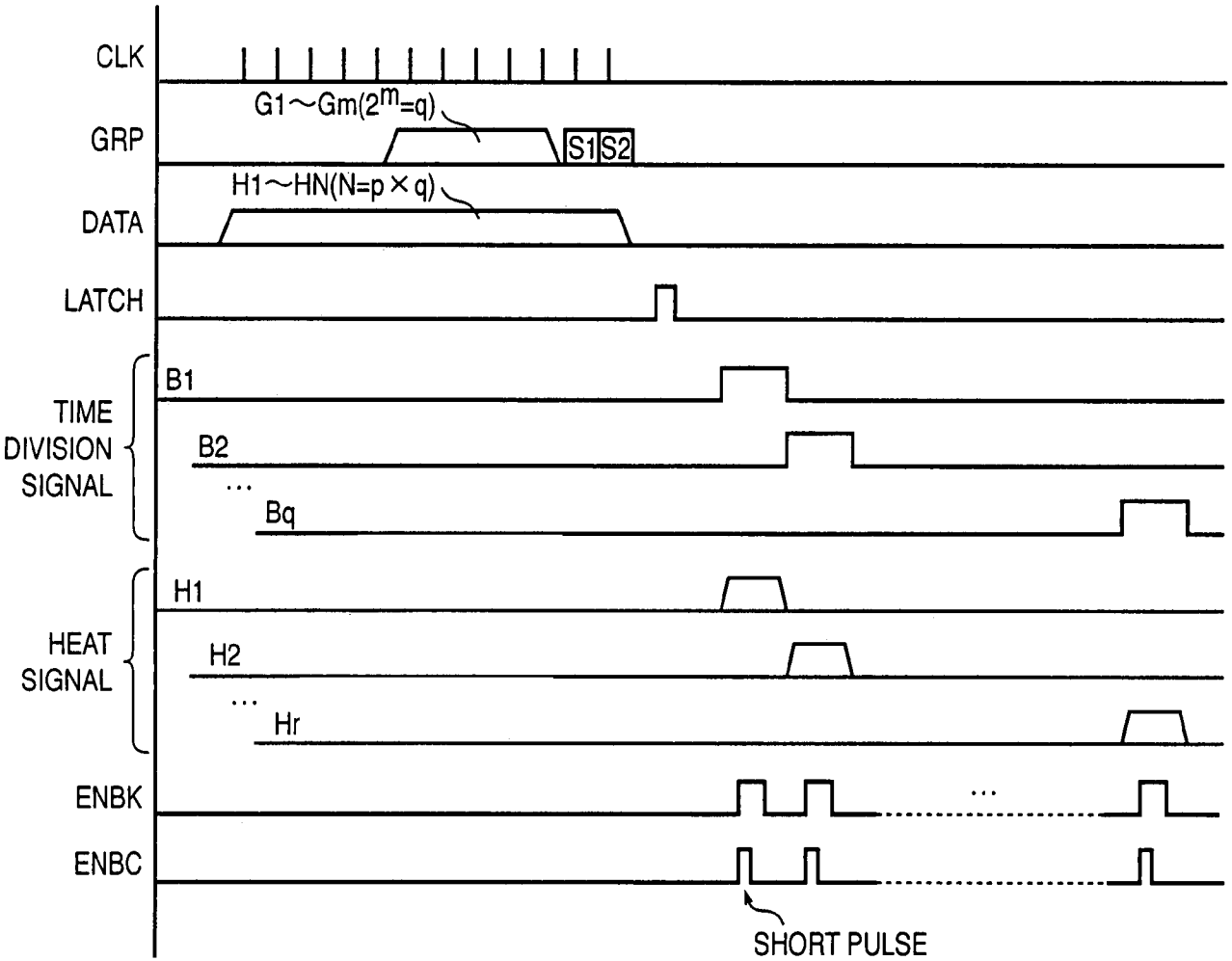
FIG. 7 is a timing chart showing the signals of signal lines which are supplied to the head substrates shown in FIG. 6.

FIG. 7 is a timing chart showing the signals of signal lines which are supplied to the head substrates shown in FIG. 6.

In the arrangement shown in FIGS. 6 and 7, group signals (G1 to Gm) and a 2-bit (S1 and S2) data select signal are input via the group signal line (GRP). In the monochrome printing head substrate 100K, the S1 bit out of the data select signal (S1 and S2) is supplied to the switch 109, while the S2 bit has no connection. In the color printing head substrate 100C, the S1 bit has no connection, while the S2 bit is supplied to the switch 109.

In this fashion, the group signal line (GRP) is shared between the printhead IJHK (i.e., head substrate 100K) and the printhead IJHC (i.e., head substrate 100C). In order to switch between a printing signal and predetermined fixed data, the data select signal (S1 and S2) used in the switch 109 utilizes pieces of information at different bit positions between the head substrates 100K and 100C.

When the printhead IJHK prints by discharging black ink, the data select signal bit S1 of the head substrate 100K causes the switch 109 to select a printing signal, thus outputting heat signals (H1 to HN) based on the printing signal. At this time, the data select signal bit S2 input to the head substrate 100C of the printhead IJHC which does not print is an inverted signal of the data select signal input to the head substrate 100K. The data select signal bit S2 causes the switch 109 to select predetermined fixed data, thus outputting the data to the shift register 106. At this time, a driving pulse having a short pulse width not enough to discharge ink is properly input to the head substrate 100C of the printhead IJHC via the heat pulse signal line (ENBC).

The arrangement of the head substrate allows sharing a larger number of signal lines.

The above-described 2-head substrate arrangement adds only one switch and a capacity of 1 or 2 bits in the shift register. This only slightly increases the circuit scale and wiring so as to input an output of 1 or 2 bits to the added switch. Thus, low-cost, appropriate temperature adjustment can be implemented without complicating the circuit arrangement.

[Other Embodiment]

This embodiment further simplifies the arrangement of the above-described embodiment. The number of shift registers which is two on each head substrate in the above-described embodiment is decreased to one. In addition to a printing signal, group signals (G1 to Gm), a latch reset signal (to be described later), and a driving pulse control signal (to be described later) are input via a printing signal line (DATA). This arrangement will be described.

Figure 8:
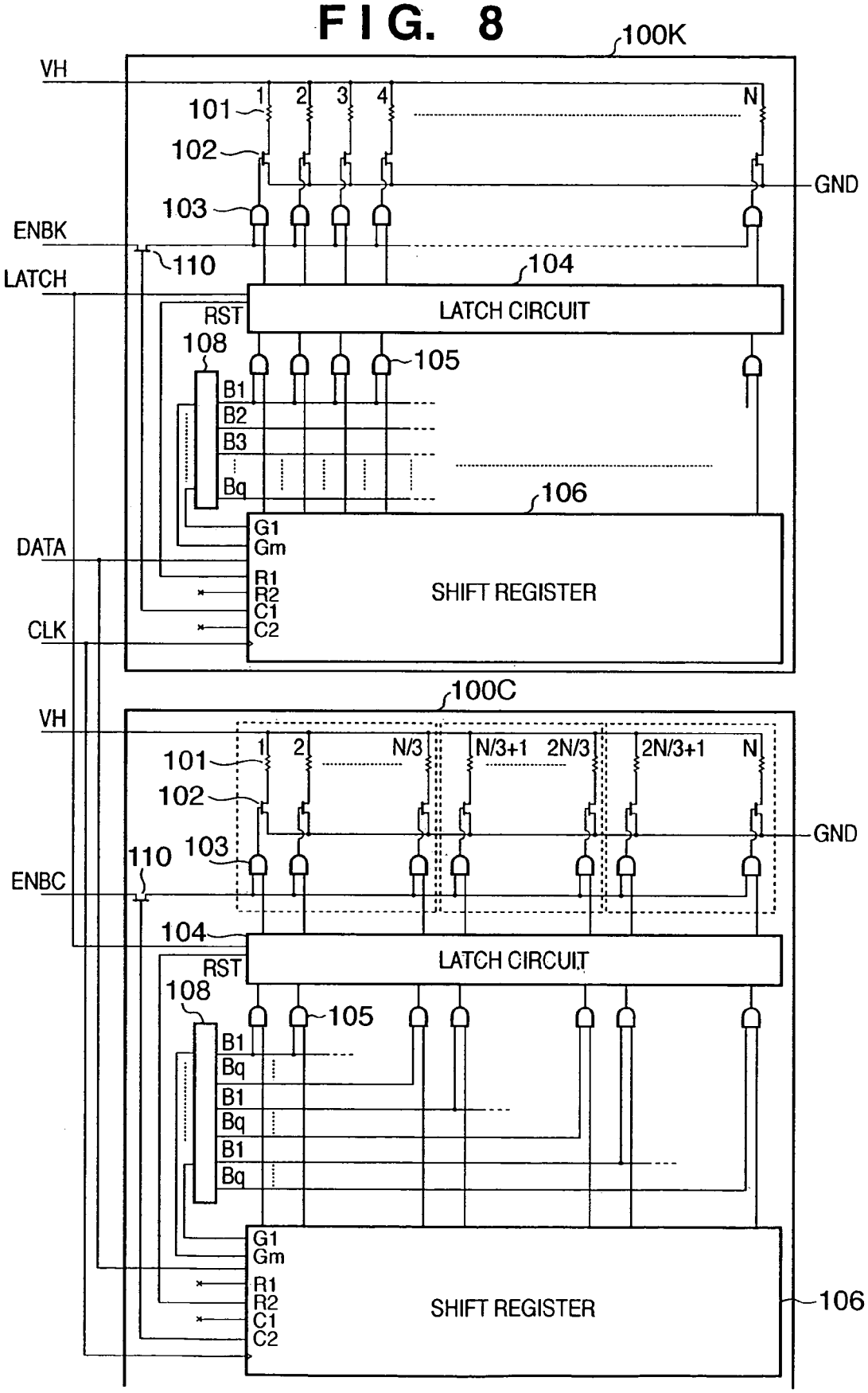
FIG. 8 is a circuit diagram showing the arrangement of head substrates integrated in a printhead IJH according to another embodiment.

FIG. 8 is a circuit diagram showing the arrangement of head substrates according to this embodiment. In FIG. 8, the same reference numerals and signs as in FIG. 4 and FIG. 11 showing the prior art denote the same constituent elements and signal lines, and a description thereof will be omitted.

Figure 9:
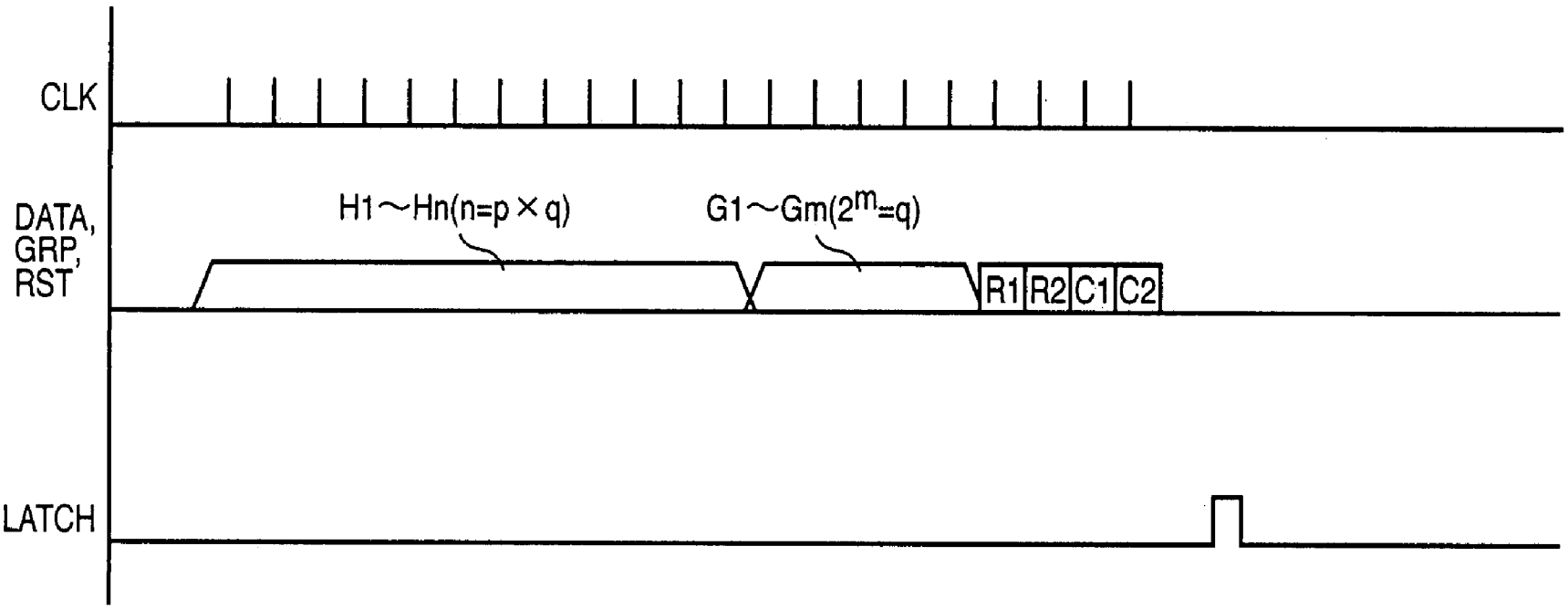
FIG. 9 is a timing chart showing the signals of signal lines which are supplied to the head substrates shown in FIG. 8.

FIG. 9 is a timing chart showing the signals of signal lines which are supplied to the head substrates shown in FIG. 8.

In the arrangement shown in FIG. 8, a latch circuit 104 on each head substrate has a reset terminal (RST), and receives one bit output from a shift register 106 as a latch reset signal.

As shown in the timing chart of FIG. 9, a 2-bit (R1 and R2) latch reset signal is input via the printing signal line (DATA) subsequently to a printing signal and group signals. In a head substrate 100K, one latch reset signal bit (R1) out of the 2-bit signal is extracted from the shift register 106, and input as a reset signal to the reset terminal (RST) of the latch circuit 104. The other latch reset signal bit (R2) is left unused. In a head substrate 100C, one latch reset signal bit (R1) is left unused, and the other latch reset signal bit (R2) is input as a reset signal to the reset terminal (RST) of the latch circuit 104.

When the latch circuit 104 according to the embodiment receives the reset signal, the circuit 104 controls the output value in accordance with a combination of the value of the reset signal and the value of an input signal from the shift register 106 (accurately, an output signal from an AND circuit 105).

FIG. 10 is a table showing the relationship between the input signal and output signal of the latch circuit.

In the example shown in FIG. 10, when the reset signal bit (R1 or R2) is at low level "L", an input signal from the AND circuit 105 is output without any change. When the reset signal bit is at high level "H", an output from the latch circuit is always kept at high level "H" regardless of an input signal from the AND circuit 105, i.e., a signal output for driving, e.g., all printing elements is obtained.

In the head substrate 100K, of a 2-bit (C1 and C2) driving pulse control signal input to the shift register 106 via the printing signal line (DATA), one driving pulse signal bit (C1) is extracted from the shift register 106, and input as a driving control signal to a driving pulse control switch 110. The other driving pulse signal bit (C2) is left unused. In the head substrate 100C, one driving pulse signal bit (C1) is left unused, and the other driving pulse signal (C2) is input as a driving control signal to the driving pulse control switch 110.

In this embodiment, when a printhead IJHK prints, one latch reset signal (R1) to the latch circuit 104 of the head substrate 100K is kept at low level, and the printing signal is output to each AND circuit 103 without any change. When a heat pulse signal from a heat pulse signal line (ENBK) is input to the AND circuit 103 in response to the driving pulse signal (C1), a MOS-FET transistor 102 drives a corresponding printing element to discharge ink and print during the period of the driving pulse signal.

At this time, the other latch reset signal bit (R2) to the latch circuit 104 of the head substrate 100C in the printhead IJHC which does not print is kept at high level, and the latch circuit 104 outputs a predetermined signal (e.g., a signal for driving all printing elements) to the AND circuit 103. A predetermined number of driving pulses having a short pulse width not enough to discharge ink are applied via a heat pulse signal line (ENBC) in accordance with the other driving pulse signal bit (C2). Consequently, the printing element generates heat to adjust the printhead temperature. Note that the above predetermined signal includes not only a signal which is unchangeable once preset (i.e. a fixed signal) but also a signal which is changeable depending on printing environment or printing operation even though it is preset.

In the next scanning, the printhead to be driven changes to the printhead IJHC, while the printhead IJHK does not print. At this time, a driving pulse having a short pulse width not enough to discharge ink is properly input to the head substrate 100K of the printhead IJHK via the heat pulse signal line (ENBK), thereby performing the same control as that described above.

According to the embodiment, signal lines connected to the two head substrates can be further shared. Also, shift registers in each substrate are combined, and the head temperature can be adjusted with a simpler circuit arrangement.

The driving pulse control switch 110 can also be employed in the above-mentioned embodiment.

As many apparently widely different embodiments of the present invention can be made without departing from the spirit and scope thereof, it is to be understood that the invention is not limited to the specific embodiments thereof except as defined in the appended claims.

What is claimed is:

1. A printhead comprising:

a first printhead substrate;

a second printhead substrate; and at least one signal line shared between said first printhead substrate and said second printhead substrate, wherein said first printhead substrate comprises:

a plurality of printing elements, each including an electrothermal transducer, a selection circuit which selects, in accordance with an input control signal, a printing signal input via a signal line or a predetermined signal for driving said plurality of printing elements, and an input unit which inputs a driving signal for driving said plurality of printing elements, wherein in a case where printing operation by driving said plurality of printing elements in accordance with the printing signal is suppressed, said selection circuit selects the predetermined signal, and drives said plurality of printing elements on the basis of the predetermined signal by a short pulse signal insufficient to print, and wherein said shared signal line is used for time-divisionally inputting a selection signal for driving said plurality of printing elements and the control signal, the control signal includes at least a 2-bit signal, and one bit of the 2-bit signal is input as a dedicated control signal to said selection circuit exclusively from said second printhead substrate.

* * * * *